US006755482B2

(12) United States Patent
Johnson

(10) Patent No.: US 6,755,482 B2
(45) Date of Patent: Jun. 29, 2004

(54) CUTTING MACHINE WITH FLYWHEEL GEARBOX DESIGN AND METHOD FOR USE

(75) Inventor: H. Matthew Johnson, Shermansdale, PA (US)

(73) Assignee: Surface Preparation Technologies, Inc., Mechanicsburg, PA (US)

( * ) Notice: Subject to any disclaimer, the term of this patent is extended or adjusted under 35 U.S.C. 154(b) by 0 days.

(21) Appl. No.: 10/143,147

(22) Filed: May 10, 2002

(65) Prior Publication Data

US 2002/0192025 A1 Dec. 19, 2002

Related U.S. Application Data

(60) Provisional application No. 60/293,567, filed on May 25, 2001.

(51) Int. Cl.[7] ..... E01C 23/20

(52) U.S. Cl. ..... 299/39.4; 404/93; 404/75; 74/572

(58) Field of Search ..... 299/36.1, 38.1, 299/39.1, 39.4, 39.9, 40.1, 106; 404/84.05, 90, 95, 75, 87, 93; 74/572, 414

(56) References Cited

U.S. PATENT DOCUMENTS

| | | | | |
|---|---|---|---|---|
| 4,270,410 A | | 6/1981 | Herscovici | |
| 4,281,560 A | | 8/1981 | Herscovici | |
| 4,701,069 A | * | 10/1987 | Whitney | 404/75 |
| 4,797,025 A | * | 1/1989 | Kennedy et al. | 404/90 |
| 4,854,769 A | * | 8/1989 | Fukukawa et al. | 404/72 |
| 4,878,713 A | * | 11/1989 | Zanetis | 299/39.5 |
| 4,900,094 A | * | 2/1990 | Sergeant | 299/39.6 |
| 5,078,540 A | * | 1/1992 | Jakob et al. | 404/90 |
| 5,094,565 A | | 3/1992 | Johnson | |
| 5,104,195 A | * | 4/1992 | Zaccho | 299/39.3 |
| 5,201,836 A | * | 4/1993 | DeWitt | 280/426 |
| 5,215,071 A | * | 6/1993 | Mertes et al. | 125/13.01 |
| 5,297,894 A | * | 3/1994 | Yenick | 404/90 |
| 5,415,495 A | | 5/1995 | Johnson | |
| 6,454,490 B1 | | 9/2002 | Murphy | |

OTHER PUBLICATIONS

Gear Box Design with Flywheel for Reduced Vibrations and Energy Savings, by Paul Herscovisi, published in 1980 by Society of Automotive Engineers, Inc.

* cited by examiner

*Primary Examiner*—David Bagnell
*Assistant Examiner*—Daniel P Stephenson
(74) *Attorney, Agent, or Firm*—Carmen Santa Maria; K. Scott O'Brian; McNees Wallace & Nurick LLC

(57) ABSTRACT

A cutting machine for cutting depressions in a road surface. The cutting machine includes a rotatable cutting drum connected with a drive device for rotating the cutting drum and an engaging device for moving the cutting drum out of and into contact with the road surface. The drive device includes a gear box with a flywheel located on the input side of the gear box and the cutting drum comprises a plurality of cutting teeth, the teeth removably retained to the cutting drum to effectively cut the road surface and includes a means for anchoring a tooth shank to a tooth holder permanently affixed to said cutting drum. A power unit that moves the cutting drum along the road surface is provided with a detector for continuously detecting a distance that the cutting drum is moved by the power unit and for generating a signal indicative of the distance moved. An electronic controller, responsive to the signal, electronically controls the engaging device so that the cutting drum moves out of and into contact with the road surface in accordance with the distance that the cutting drum moves along the road surface and a specified dimensional profile of the depressions which are stored in the electronic controller. The movement of the cutting drum cuts depressions in the road.

22 Claims, 9 Drawing Sheets

CUTTING MACHINE WITH FLYWHEEL GEARBOX DESIGN AND METHOD FOR USE

CROSS REFERENCE TO RELATED APPLICATIONS

This application claims the benefit of U.S. Provisional Application No. 60/293,567 filed May 25, 2001.

FIELD OF THE INVENTION

This invention relates to a cutting tool for cutting a series of depressions along surfaces of roadways, and more particularly to a cutting tool utilizing a flywheel gearbox design.

BACKGROUND OF THE INVENTION

As motor vehicle operators become fatigued or distracted, the possibility of the vehicle drifting off the road or over the center line and into the opposite lane of traffic increases, either of which can potentially lead to disastrous results. To minimize this occurrence, a series of depressions are cut along the shoulders or center line of the roadway, referred to as ground in rumble strips. The purpose of the rumble strip is to alert drivers when they have drifted outside their traffic lane by creating a sound and causing vibration of the vehicle as the vehicle tires travel over the depressions.

Differing designs of road surface grinders/cutting machines which use a cutting drum or drums to cut individual depressions have heretofore been devised. In older designs, cutting drums have been attached to or made part of a multipurpose power unit such as a tractor or skidsteer loader. The tractor or skidsteer loader is used to move the cutting drum along the surface of the road and to provide any necessary utilities thereto, such as electricity or hydraulic fluid. More recent designs have attached the cutting drum to a vehicle frame designed solely for use with the cutting drum. With either design, the cutting drum is lowered into contact with the road surface to cut the depression.

Current practice cutting machines use a variety of methods for engaging and disengaging the cutting drum into the road surface to cut the depression and for repositioning the cutting drum for the next cut. One method of raising and lowering the cutting drum requires an operator to manually control a hydraulic cylinder which is connected to the cutting drum. A problem with this method is that it is difficult for the operator to move the cylinder controls quickly enough to achieve a sufficient production rate (defined as forward feet per minute) while cycling the cutter.

An example of such a manually operated system is disclosed in U.S. Pat. No. 5,094,565 which utilizes a plurality of manually controlled cutting drums to cut a series of depressions at one time. The production rate is increased by using the plurality of cutting drums, which are lowered onto the road surface to cut the depressions while the power unit is stationary. After the cut is complete, the cutting drums are raised and the power unit moves to the next location. Since there is not a continuous forward movement of the power unit, additional time is required for raising and lowering the cutting drums. Additionally, since the required sizing (depth, width, length, and radius of curvature of each depression) is specified depending on the task at hand, appropriately sized cutting drums must be used in order to meet the required dimensional sizing of the depressions. Thus, if different depression sizes are required, the cutting drums may have to be replaced.

In order to overcome some of the problems with the manual systems, automated means for raising and lowering the cutting drum have been developed. Such means include rigidly connecting the cutting drums (1) to an eccentric wheel which rolls over the road surface or (2) to a cam and lever system. In each of these automated systems, the cutting drum is automatically raised and lowered as the power unit moves forward due, respectively, to the rotation of the eccentric wheel and the action of the cam and levers. These systems are an improvement over the manually operated systems since the production rate of making depressions is increased because the cutting drum cuts as the power unit moves forward.

In order to achieve higher production while cycling the cutter, the cutter must maintain a minimum cutter rpm. To achieve the desired product, i.e. a road surface depression of a specified dimension, the cutter must make at least one complete revolution while cutting each rumble strip depression. Less than one full revolution of the cutter produces an incomplete or dimensionally defective cut. In particular, the repeating cycling of the cutter against the road surface produces repeating torque peaks as the cutter initially makes contact with the road surface that must be overcome in order to produce the required full revolution of the cutter per cut.

Therefore, the maximum production rate of any cutting machine is limited by the amount of time required for the cutting drum to complete each cut. In addition, current systems can not meet maximum production rates because of inherent limitations above and beyond the cutting time required by the cutting drum to complete its cut, such as those imposed by the mechanical arrangements used to control cutter rpm and the vertical motion of the grinding drum.

U.S. Pat. No. 5,415,495, assigned to the assignee of the present invention, describes an electronic controller responsive to a signal indicative of the forward distance traveled by the cutter. The controller electronically controls an engaging device so that the cutting drum moves out of and into contact with the road surface in accordance with the distance that the cutting drum moves along the road surface and a specified dimensional profile of the depression, which are stored in the electronic controller.

One problem with this and other current practice hydrostatic drives is the elasticity of hydraulic systems. This problem causes the cutter rpm to drop off as much as 50% during the cut. In order to maintain the required minimum one full cutter rotation per cut, forward speed must be reduced, with resulting decrease in production.

One way to achieve greater production is to increase the cutter rotational speed so that when it slows down on contact with the road surface it effectively still maintains the necessary revolutions per minute to permit at least one full revolution prior to the next cycle. However, in current practice, the cutting teeth are held in their holders solely with springs that create friction. While the springs protect the tooth holder from wear and permit tooth rotation, when cutter rotational speed exceeds about 600 rpm, it is difficult to retain the cutting teeth in their holders, even using retaining springs.

Other attempts to counteract the cutting drum slowdown problem include adding torque to the hydrostatic system and increasing kinetic energy through increasing the mass of the cutting drum. For example, lead is added to the interior of the cutting drum to increase its mass and reduce the elasticity inherent in a hydraulic system.

It is often the case that the number of depressions in a given rumble strip and/or the size of the depressions in a given rumble strip are different depending on the job site.

Accordingly, in order to accommodate these changes, current practice non-electronic controller systems require the replacement of the cutting drum and/or a complete change of the mechanical control mechanism (eccentric wheel, cam/lever) in order to achieve the required depression sizing. Such reconfiguring of the cutting machine is time consuming and costly, making an electronically controlled unit desirable. In addition, it is also desirable to make these cuts as rapidly as possible.

Thus, there is a continuous need for improved designs for cutting tools to increase operating efficiencies. In particular, there remains a need to maintain cutter rpm throughout the repeating cutting cycle while encountering varying road surface conditions. The present invention fulfills this need, and further provides related advantages.

SUMMARY OF THE INVENTION

The present invention provides a cutting machine for cutting depressions in a road surface. The cutting machine includes a rotatable cutting drum connected with a drive device for rotating the cutting drum and an engaging device for moving the cutting drum out of and into contact with the road surface. The drive device includes a gear box with a flywheel located on the input side of the gear box, while the cutting drum comprises a plurality of cutting teeth, the teeth removably positioned to the cutting drum to effectively cut the road surface, and includes a means for anchoring a tooth shank to a tooth holder permanently affixed to the cutting drum.

In one form, a power unit that moves the cutting drum along the road surface is provided with a detector for continuously detecting a distance that the cutting drum is moved by the power unit and for generating a signal indicative of the distance moved. An electronic controller, responsive to the signal, electronically controls the engaging device so that the cutting drum moves out of and into contact with the road surface in accordance with the distance that the cutting drum moves along the road surface and a specified dimensional profile of the depressions which are stored in the electronic controller. The movement of the cutting drum cuts depressions in the road. An optional means is provided to prevent rear end skidding which can cause cutting drum tracking problems.

The present invention provides means for electronically controlling the vertical motion of the cutting drum of a cutting machine and automatically adjusting the cutting drum to align with the contours of the road surface as it travels over the road surface. Both of these features allow the cutting process to progress more quickly and accurately than previous road cutting machines because they impose no limitations on the depression forming production rate beyond the cutting time required by the cutting drum.

The present invention also provides a cutting machine which electronically controls the vertical movement of the cutting drum into and out of contact with a road surface, thereby allowing a power unit and the cutting drum to continuously progress forward as the cutting drum cuts depressions.

The present invention further provides a cutting drum machine which maintains cutter rotational speed above a minimum speed required throughout the repeating cutting cycle as it encounters varying road surface conditions.

The cutting machine for cutting depressions in a road surface as set forth in the present invention includes a rotatable cutting drum; a plurality of cutting teeth, the teeth removably retained to the cutting drum to effectively cut the road surface; a drive system for rotating the cutting drum and maintaining the rotational speed to provide at least one full revolution at a pre-selected depth of cut, wherein the drive system includes a gear box comprising a flywheel on an input side of the gearbox; engaging means for moving the cutting drum out of and into contact with the road surface; means for moving the cutting drum along the road surface; means for continuously detecting-the distance that the cutting drum is moved by the moving means and for generating a signal indicative of the distance moved; electronic control means, responsive to the signal, for electronically controlling the engaging means to move the cutting drum out of and into contact with the road surface in accordance with the distance that the cutting drum moves along the road surface and a specified dimensional profile of the depressions which are stored in the electronic control means so that the depressions are cut, and means for continuously aligning the cutting drum with a slope of the road surface.

The invention optionally provides electronic feedback relative to movements of the cutting drum, which feedback can be processed and displayed to the operator periodically, thereby alerting him as to whether or not the cutting drum is operating properly, that is, has sufficient time to complete the cutting cycle in relation to the forward speed of the entire cutting machine.

The invention utilizes as much weight a possible to keep the cutting drum engaged with the road surface.

The invention also provides means for both electronically and mechanically adjusting the cutting tool to vary both the depth and width of the depressions consistently across the length of the rumble strip as well as to vary the depth and width of the depressions across the length of the rumble strip, as field conditions or job specifications require.

An advantage of the present invention is that the flywheel boosts the torque applied to the cutting drum to keep it from slowing down as the cutting drum engages the road surface during a cut. This allows the mobile power unit to travel at a higher rate of speed, thereby allowing the cutting drum to make more cuts in a unit of time.

Another advantage of the present invention is that the cutting teeth design of the present invention are retained in their holders at the rotational speed of the cutting drum as the cuts are made.

Other objects, features and advantages of the present invention will become apparent to those skilled in the art from the following detailed description and drawings. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Other objects, features and advantages of the present invention will become apparent from the following detailed description and accompanying drawings wherein.

DETAILED DESCRIPTION OF THE PREFERRED EMBODIMENTS

Figure 1:
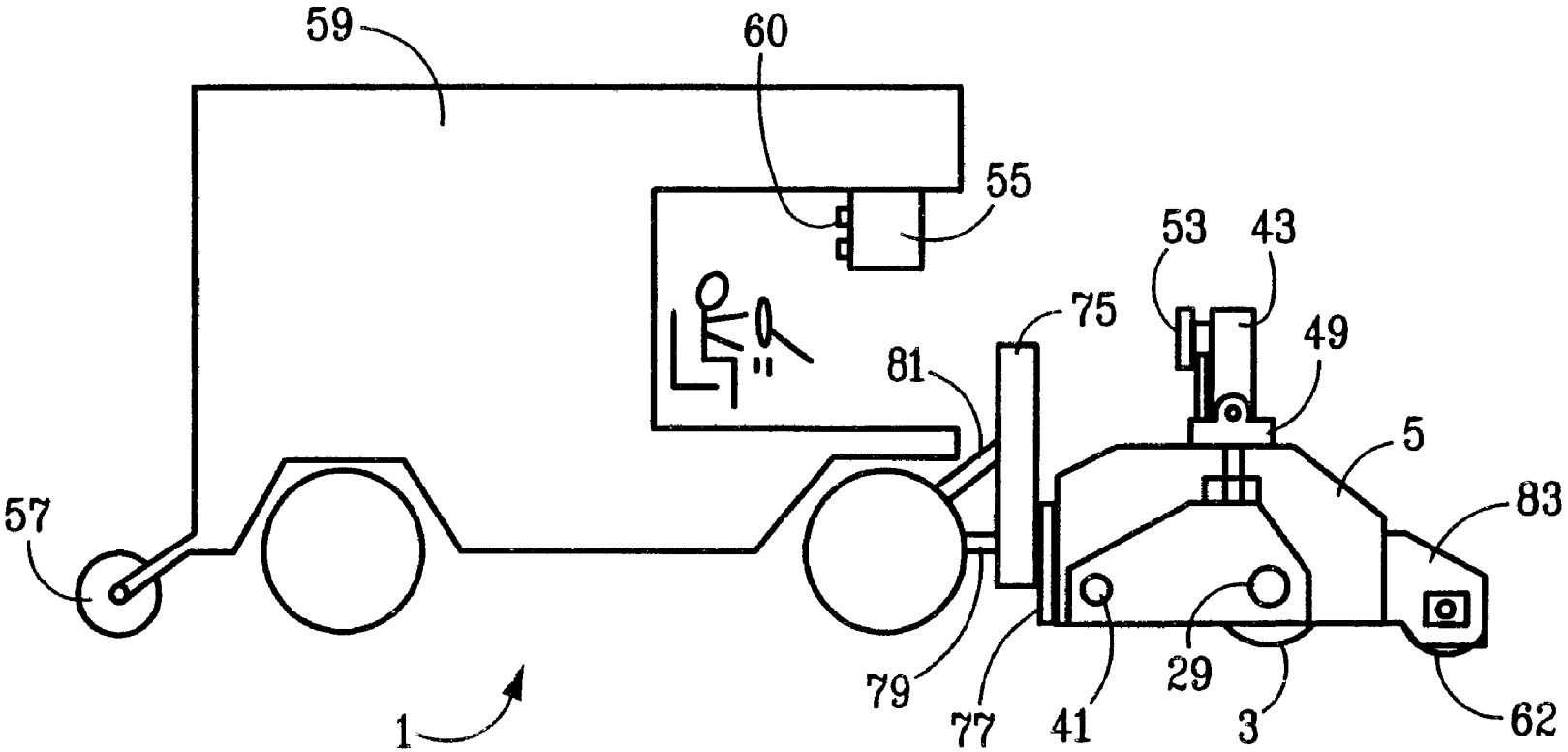
FIG. 1 is a right side view of the cutting machine.
Figure 2:
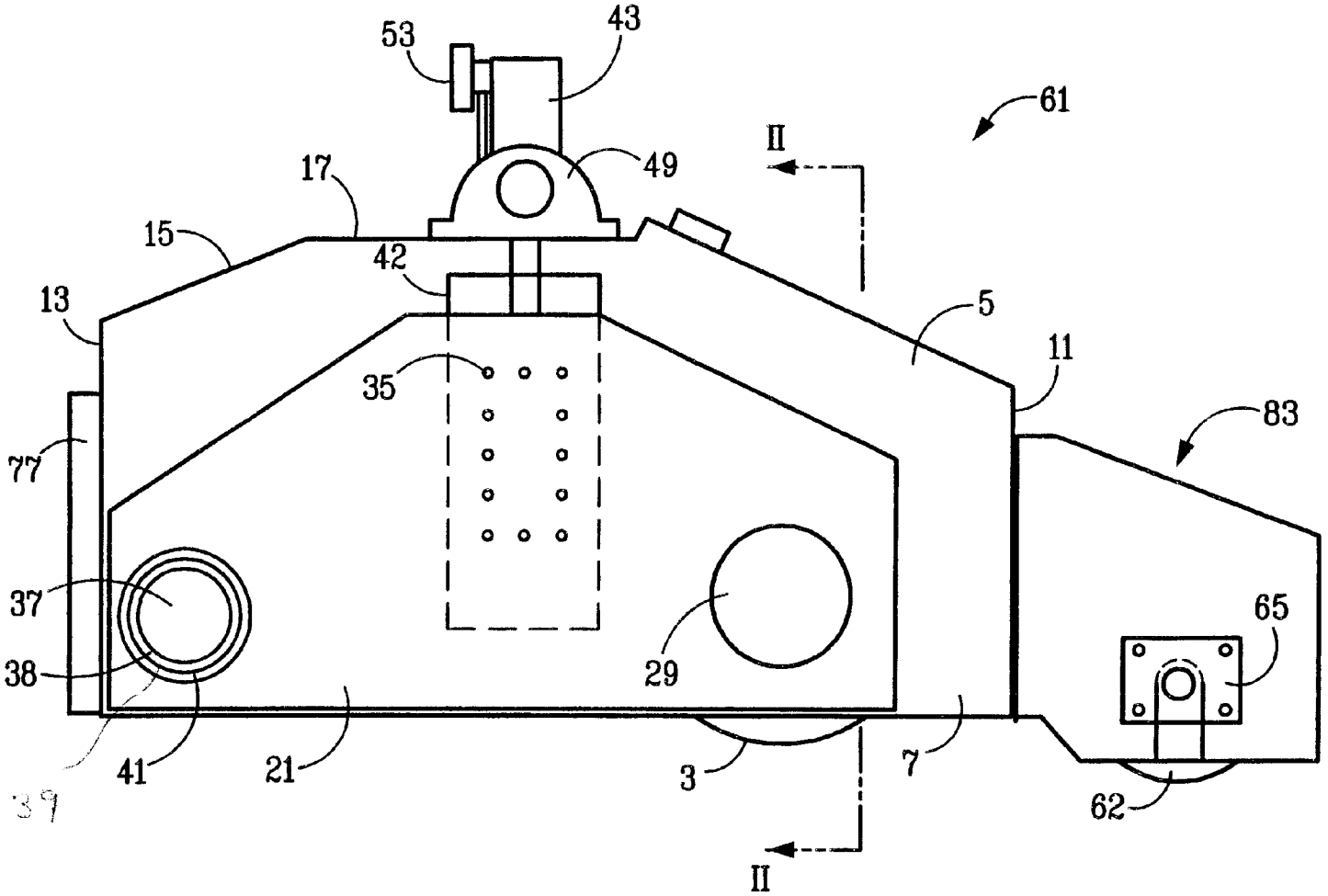
FIG. 2 is a right side view of the cutting apparatus.
Figure 3:
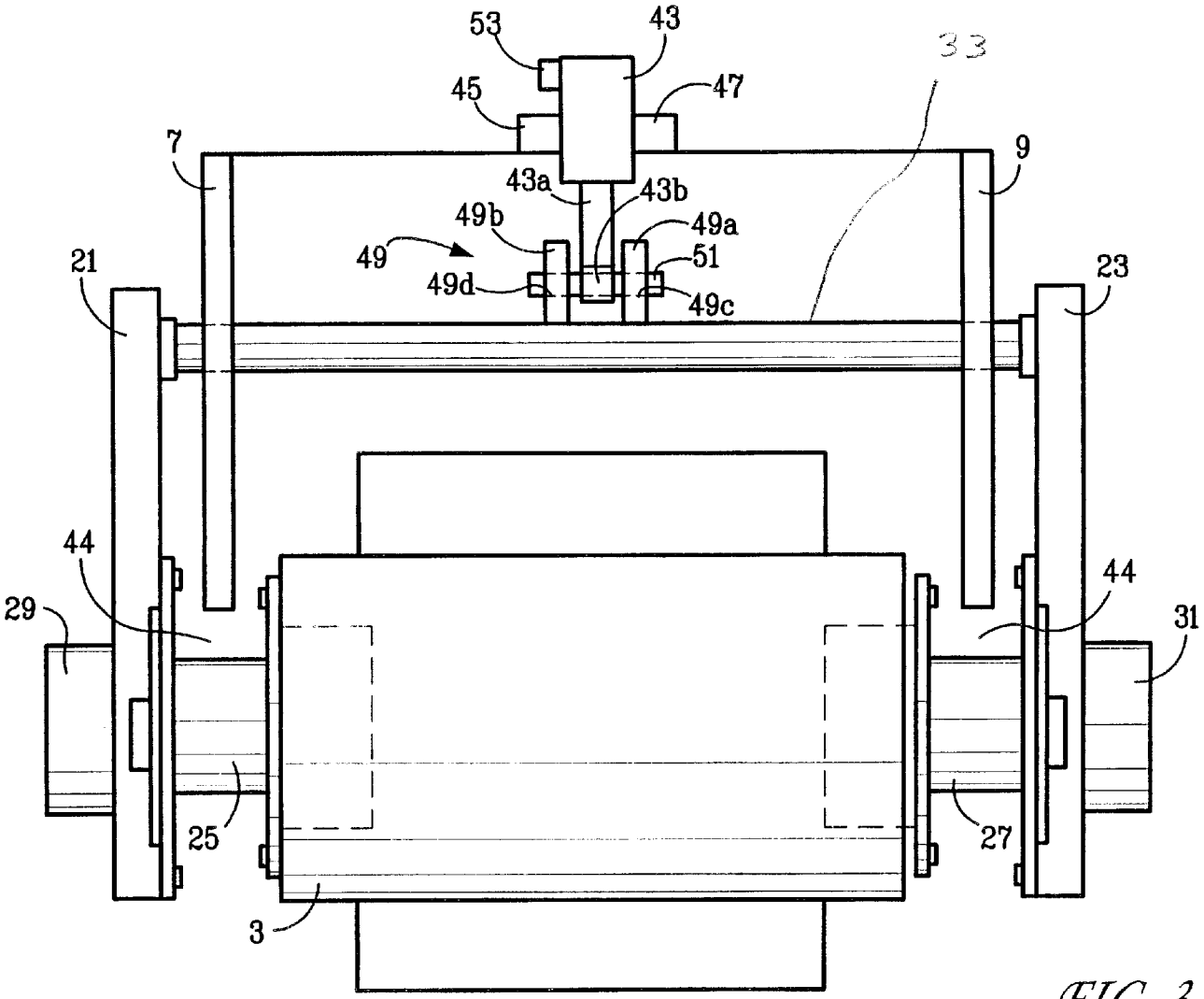
FIG. 3 is a front view of the cutting drum within the cutting machine housing as seen along the section line II—II of FIG. 2.
Figure 4:
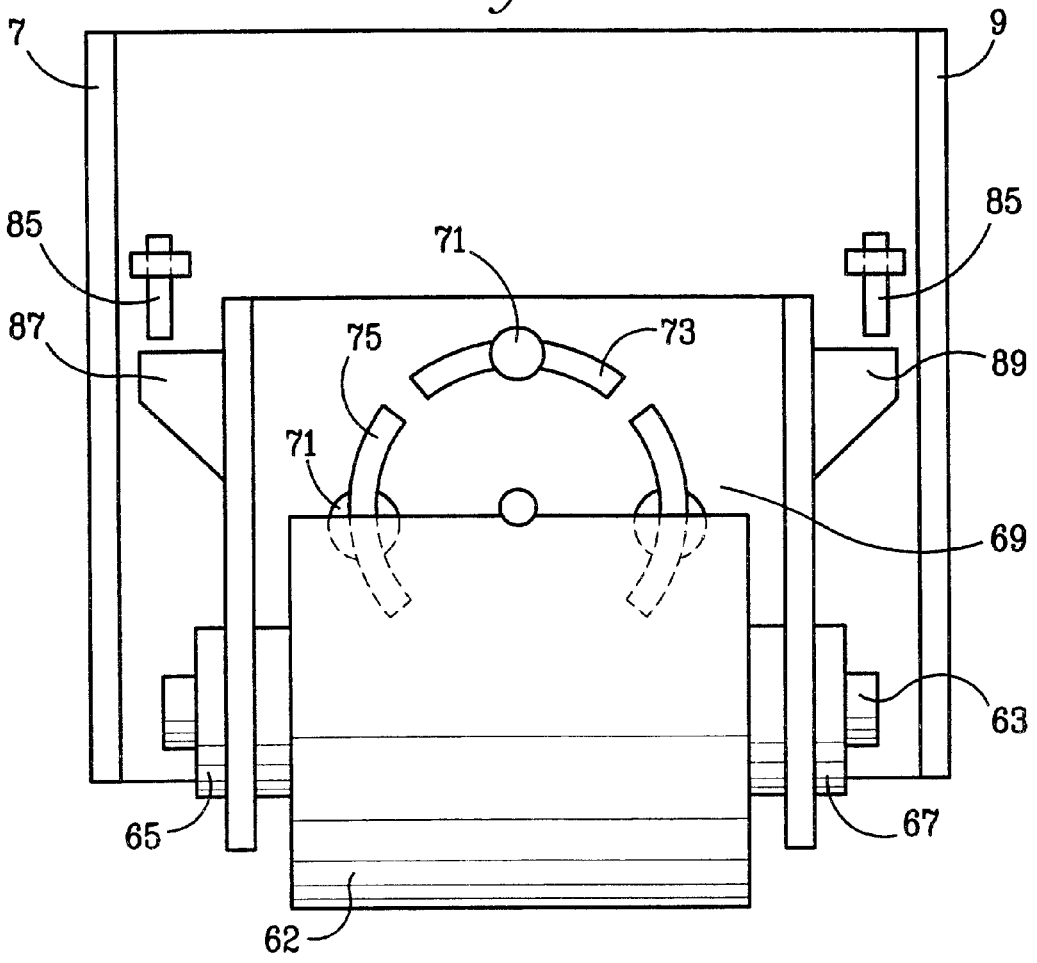
FIG. 4 is a front view of the front roller assembly.

Referring now to the drawings, and particularly to FIGS. 1–3, a cutting machine 1 includes a conventional cutting drum 3 contained within a housing 5 having a pair of opposed, substantially parallel, vertically extending side walls 7 and 9. In addition, the housing 5 contains front and rear sidewalls 11 and 13, and two top plates 15, 17 forming part of the top of the housing 5. Access to the inside of the housing 5 from the top is accomplished via a door (not shown). The bottom of housing 5 is completely open.

Referring to FIGS. 2 and 3, cutting drum 3 is carried within housing 5 by two arm plates 21 and 23. The cutting drum 3 is attached to each of the arm plates 21 and 23 through respective gear boxes 25 and 27. The gear boxes 25 and 27 are each rigidly attached at one end thereof to the respective arm plate 21, 23, which allows the opposite end of the gear boxes 25 and 27 to rotate the cutting drum 3. The gear boxes may be attached to the inner side of respective arm plate 21, 23, as shown in FIG. 3, or to the outer side of respective arm plates 21, 23 to allow accommodation of a larger gear box, each gear box including an integral fly wheel.

The cutting drum 3 is driven in a conventional manner by two hydraulic motors 29 and 31 which are respectively mounted through the arm plates 21 and 23 and into a respective gear box 25 and 27. Optionally, only a single gear box and motor can be utilized. The cutting drum 3 is rotated, preferably in a counter clockwise/up cut direction relative to a road surface, and uses hardened teeth, for example, milling/mining tungsten carbide tipped teeth to cut with. While a hydraulic motor driven system for the cutting drums has been described, other conventional direct or indirect drive systems can be used in lieu thereof, such as a belt driven or electric systems. To increase cutting drum inertial mass, the cutting drum may be filled with a high mass material, for example, lead.

Power is provided to the gear box 25 by a hydraulic motor attached to an input shaft in the conventional manner. Referring now to FIGS. 6*a*–6*d*, each gear box 25, 27 comprise a gear reducing gear box 160 with a flywheel 162 of the present invention on the input side 164 or shaft of the gearbox, such as those produced by Power Engineering & Mfg., Ltd. of Waterloo, Iowa. and described in U.S. Pat. Nos. 4,281,560 and 4,270,410, incorporated by reference herein. The gearbox and fly wheel design criteria are set forth in a paper entitled *Gear Box Design with Flywheel for Reduced Vibrations and Energy Savings* by Saul Herscovici, published in 1980 by Society of Automotive Engineers, Inc. and incorporated herein by reference. The reducing gear box 160 turns the output shaft which then transfers the power to rotate the cutting drum. The flywheel 162 provides an instantaneous increase in torque by increasing kinetic energy. The size of the flywheel 162 is determined by the amount of inertial torque required to overcome the peak torque value encountered as the cutting drum 3 first encounters the road surface during each cutting cycle to counteract the inertial forces of the road in slowing down the cutting drum. The flywheel size is determined by the amount of torque required to be provided, the torque to be released by the flywheel 162, the change in speed of the flywheel 162 in providing the additional torque and the reduction ratio provided by the reduction gear box 160 for a predetermined set of operating conditions. Inertial torque is released while the flywheel 162 is decreasing in speed. In a preferred embodiment, the gear box 25, 27 has a flywheel 162 that is about 6 inches to about 20 inches, preferably about 12 inches to about 14 inches in diameter and a width sufficient to add the desired amount of mass, currently about 2 inches to about 4 inches wide and operating at about 2,000 to about 3,000 rpm. A typical gear reduction ratio provided by the reduction gear box can range from about 2:1 to about 6:1, with a reduction ratio of about 4:1 being the most common and currently the best mode for practicing the present invention.

Optionally, the flywheel 162 may include a slip clutch (not shown) for those applications which produce a peak torque value sufficient to abruptly stop the cutting drum 3 and stall the gear box 25, 27. The slip clutch allows the kinetic energy stored in the flywheel 162 to be dissipated through friction without damaging the gears, flywheel or the cutting drum.

Figure 7A:
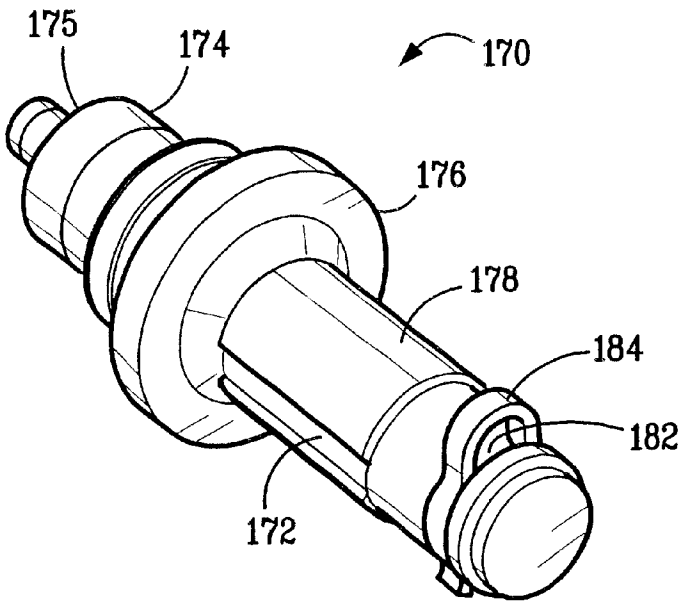
FIG. 7*a* is an oblique view of a cutting tooth with a retaining clip.
Figure 7B:
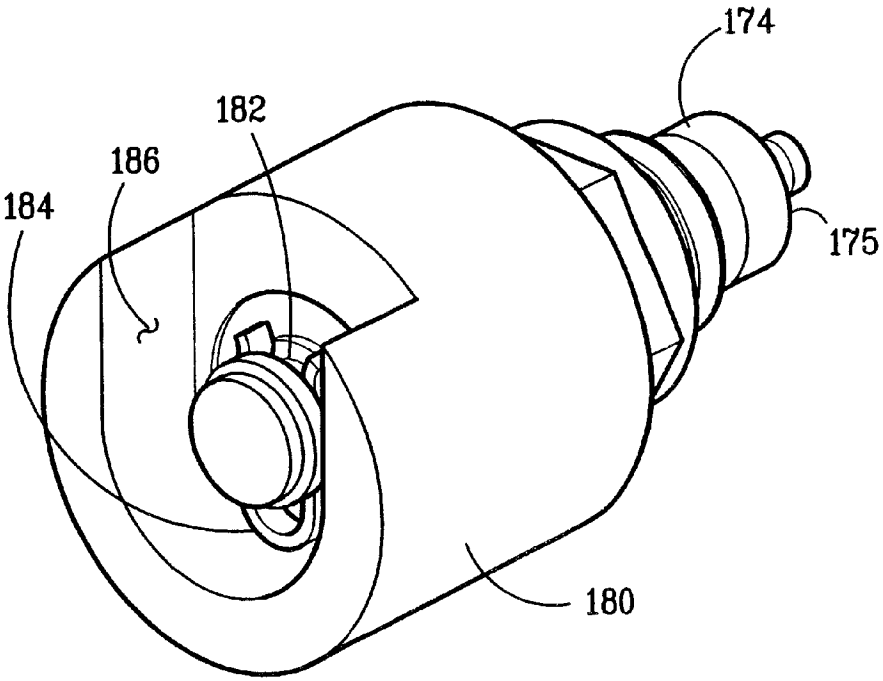
FIG. 7*b* is an oblique view of a cutting tooth retained with a retaining clip in a tooth holder.

Referring to FIGS. 7*a*–7*b*, each cutting tooth 170 extends radially from cutting drum 3 and includes a shank 172 and a cutting portion 174. Each cutting drum includes a plurality of cutting teeth 170 to provide cutting action against a road surface as cutting drum 3 rotates. The cutting portion 174 of each tooth is fabricated from a hardened material having excellent wear resistance, for example, tungsten carbide to increase service life, and has an effective cutting shape, for example, cylindrical with a cutting edge 175. The cutting portion 174 further includes a stop portion 176, for example, a shoulder, located at the cutting portion—shank junction. In a preferred embodiment, shank 172 is substantially round in cross section, although it may be oval, square, hexagonal or any other cross sectional shape permitting it to be removably retained within a tooth holder 180. In a preferred embodiment, the tooth shank 172 is partially covered by a spring 178 for additional retention within the tooth holder 180. The tooth shank 172 includes a retainer receiver 182 which is not covered by the optional spring 178, for example, a groove, hole, threads or slot for receiving a retainer 184, for example, a spring clip, mating threads or cotter pin which positively maintains each of cutting teeth 170 within their respective tooth holder 180, yet allows the cutting teeth to be easily removed from tooth holder 180 as they wear below dimensions required to provide an acceptable cut as determined by applicable specification requirements. To accommodate the retainer at the end of the tooth opposite the cutting edge, the overall tooth length has been increased. This overall lengthening of the tooth has the added effect of increasing the mass of the system and improves the ability of the teeth to remain in contact with the road surface.

Each tooth holder 180 is permanently affixed to the cutting drum 3 using known methods, such as welding, and has an opening which in cross section mirrors that of the tooth to allow the spring covered tooth shank to be received in substantially intimate contact with the tooth holder 180. The shoulder 176 provides a positive stop for tooth 170 against tooth holder 180. In a preferred embodiment, tooth holder 180 has an access port 186 to permit a retainer 84, such as a spring clip, to be affixed to the tooth shank retainer receiver 182, which may be for example a groove, thereby providing increased resistance to inadvertent removal or loss of tooth 170 as the rapidly rotating drum contacts the fixed and immovable road surface, thereby allowing for increased cutting drum rotational speed.

Referring again to FIGS. 2 and 3, the arm plates 21, 23 are interconnected at one end by the cutting drum 3 and drive mechanism described above. The arm plates 21, 23 are also interconnected by an I-beam 33 which is connected to each arm plate 21, 23 via bolts 35. The arm plates 21, 23 are also connected at the rear of the housing 5 by a solid shaft 37 which pivots against bearings 39, each of which are contained in a tube 41. The tube 41 is welded to and made part of housing 5. The combination of the shaft 37, bearings 39 and tube 41 allows the cutting drum 3 and arm plates 21, 23 to pivot up and down. The up and down movement of cutting drum 3 allows it, and therefore the cutting teeth 170 radially extending therefrom, to be engaged and disengaged with the road surface. Moreover, slots or opening 42 are provided in the side walls 7 and 9 to accommodate the movement of the I-beam 33. Additional slots or openings 44 which extend from the bottom edges of side walls 7, 9 allow for movement of cutting drum 3 and drive mechanism without interference from the side walls 7, 9.

The cutting mechanism, which includes cutting drum 3, arm plates 21, 23 and gear boxes 25, 27, is raised and lowered by a hydraulic cylinder 43 which is attached to the top plate 17 of the housing 5 by pillow block bearings 45 and 47 and to the I-Beam 33 by an attachment device 49. The attachment device 49 includes two lug portions 49*a*, 49*b* each having a through opening 49*c*, 49*d* therein. The piston 43*a* of hydraulic cylinder 43 has a through opening 43*b* which can be aligned with through openings 49*c*, 49*d*, such that a pin 51 passes through openings 49*c*, 49*d* and 43*b*, thereby connecting the hydraulic cylinder 43 to the cutting mechanism.

Control of the hydraulic cylinder 43 is accomplished via an electronic servo valve 53. The electronic servo valve 53, which reacts more quickly than prior art electronic proportional valves used in prior designs, is activated to either raise or lower piston 43*a* of cylinder 43 according to programmed instructions from a computer controller 55, FIG. 1. The computer controller 55 is programmed to precisely lower and raise the piston 43*a* to programmed depths as the cutting drum 3 advances across the road surface. The computer controller 55 receives electronic impulses which correspond to the distance traveled by the cutting machine 1 from a conventional wheel mounted encoder 57 which is disposed on a power unit 59, preferably the rear of the unit. The power unit 59 can be, for example, a motor vehicle such as a flat bed truck, a skidsteer loader or a tow tractor, and provides utilities such as electricity, water or hydraulics to the various components of the cutting machine 1. The power unit 59 also moves the entire cutting machine 1 along the road surface. The encoder 57 is also referred to as a rotary pulse generator and is, for example, produced under the name "Optical Incremental Encoder" by Allen-Bradley, Inc. of Manchester, N.H.

Figure 5:
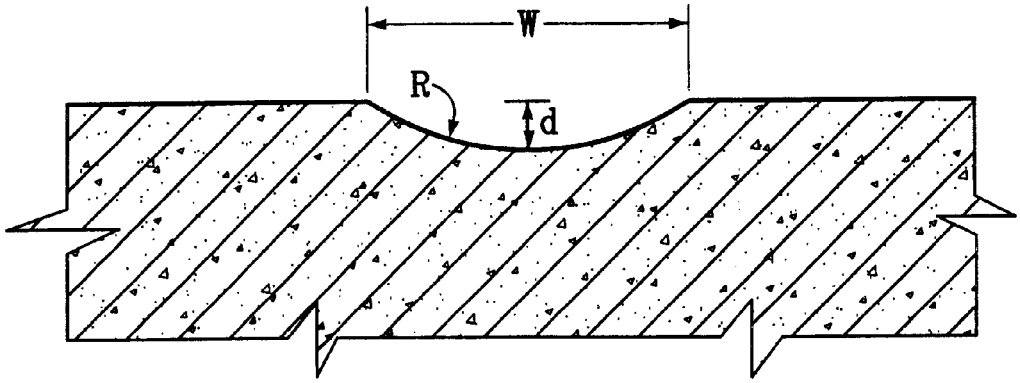
FIG. 5 is a cross-sectional view of a depression in a road surface.
Figure 6B:
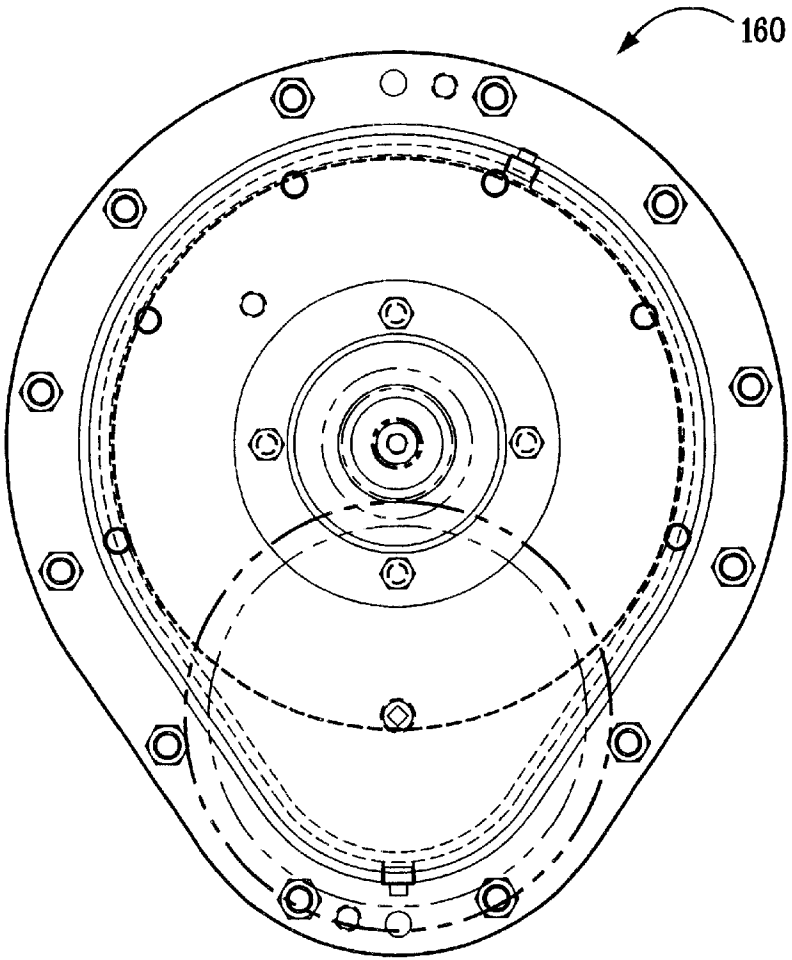
FIG. 6*a*–6*d* are schematic representations of the gearbox.
Figure 6A:
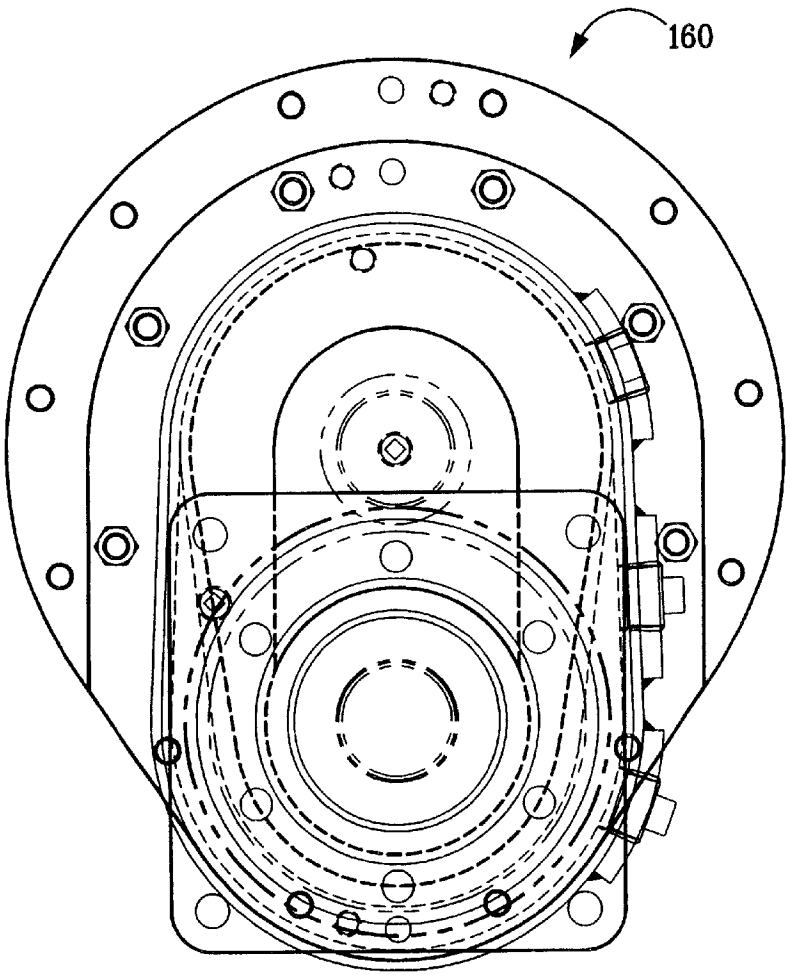
Figure 6C:
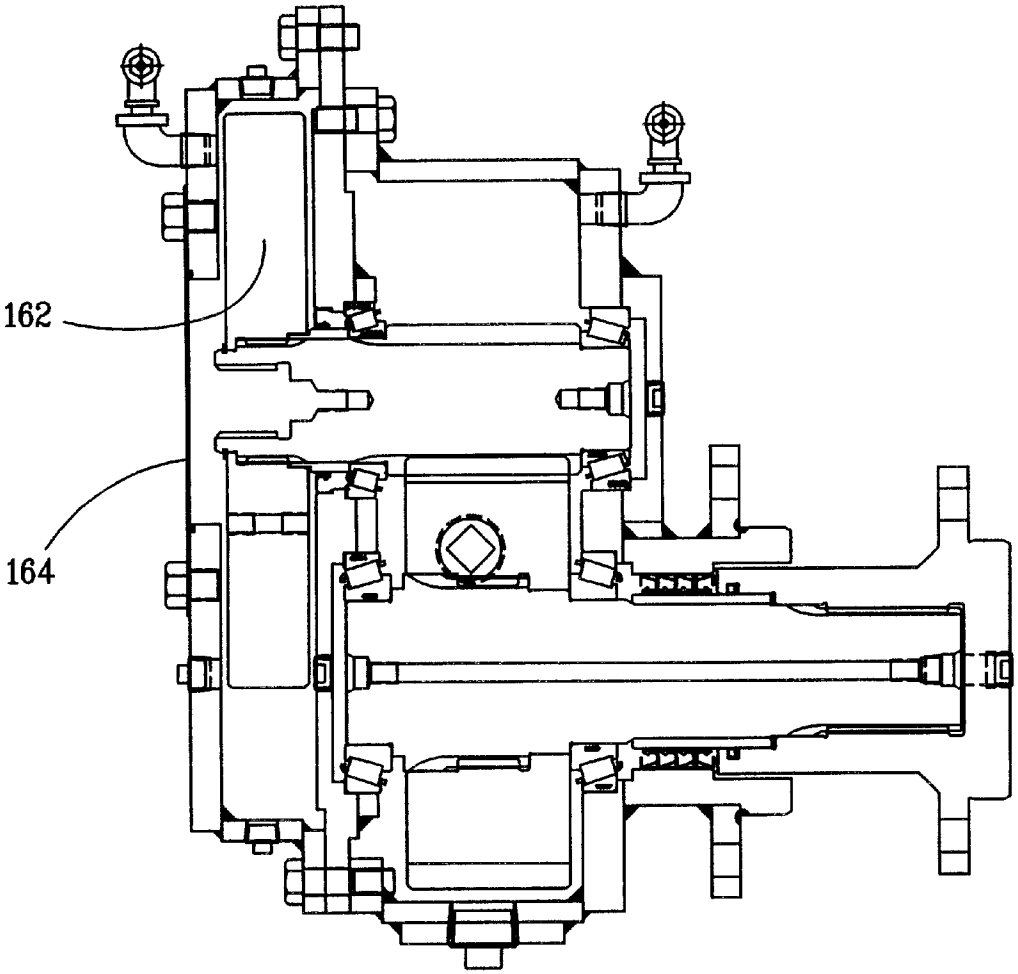
Figure 6D:
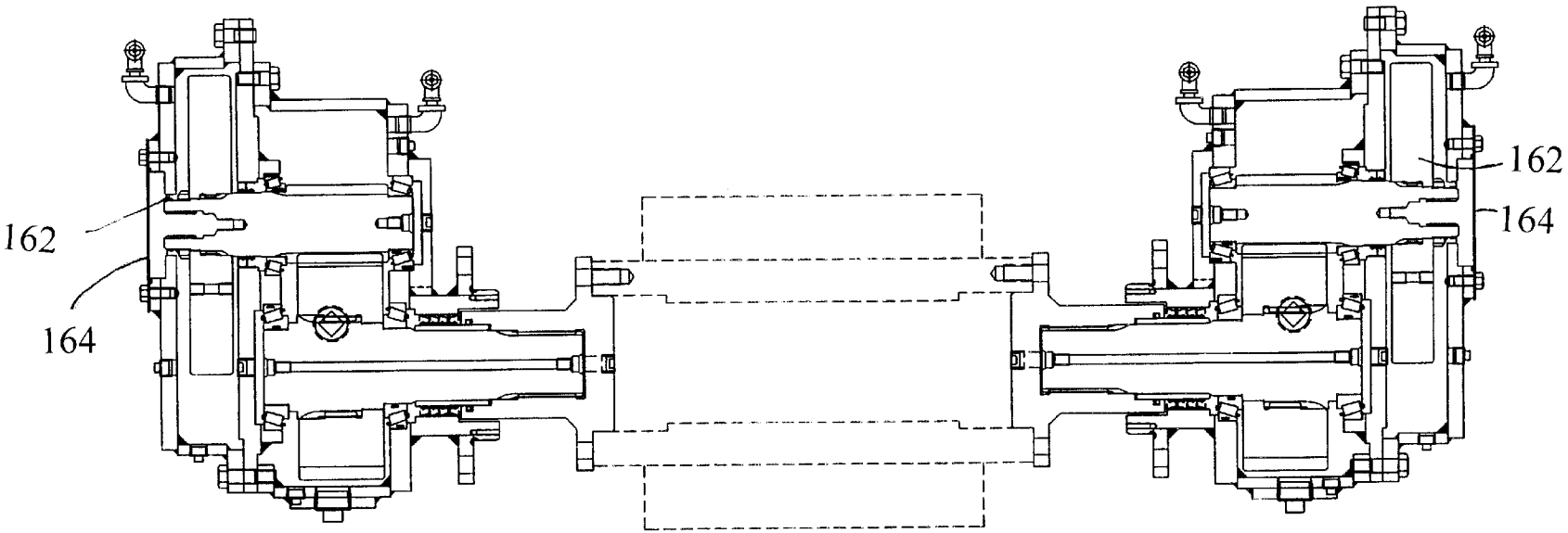

As the forward speed of the power unit 59 changes, the rate of electronic impulses being received by the controller 55 from encoder 57, correspondingly changes, so that the distance traveled along the road surface by the cutting machine 1 is continuously calculated by the controller 55 based on the input from encoder 57. The computer controller 55 adjusts the speed at which the piston 43*a* of the cylinder 43 is raised and lowered in order to complete its preprogrammed cycle within the forward distance traveled. This rate of vertical motion directly corresponds to the forward speed of the machine. Thus, referring to FIG. 5, as the cutting drum 3 moves along the width "W" corresponding to the specified width of a depression, the hydraulic piston 43*a* is raised or lowered at a rate sufficient to obtain the required depression depth "d" into the road surface in accordance with a specified radius of curvature "R". It will be understood that as cutting teeth 170 wear below a minimum dimension, they may no longer provide a required dimension depth "d" dictated by specification and require replacement.

Preprogrammed instructions pertaining to different cylinder stroke cycles relative to required depression sizing and equipment speed are stored and saved in the computer controller 55. This allows the operator to quickly and easily adjust the depth and width of the cuts according to specifications or as field conditions require. These instructions may be in the form of an algorithm.

The hydraulic cylinder 43 is a type which contains conventional internal position sensors (not shown) which can provide electronic feedback to the computer controller 55 that is indicative of the position of piston 43*a*. This allows the computer controller 55 to check the actual stroke distance of the cylinder 43 as it travels, and to inform the machine operator by, for example, a visual display 60, such as a series of lights, LED readout, or computer monitor as to whether or not the cylinder completed its programmed cycle in accordance with the computer controller 55 instructions. Thus, for example, if the power unit 59 is moving too fast such that the cut cannot be completed as required, the operator will be alerted.

Referring now to FIGS. 1 through 4, the mobile power unit 59 pushes the entire cutting tool apparatus 61 across the road surface. The cutting tool apparatus 61 is supported on a front end thereof by a solid steel roller 62 which is affixed to a shaft 63 which is carried by two bearings 65 and 67. The bearings 65 and 67 are bolted to a roller housing assembly 69 which is firmly attached to the front of the cutter housing 5 by a series of bolts 71 and slots 73 formed in the roller housing assembly 69.

The entire cutting tool apparatus 61 via the housing 5, is attached to a mast 75 of the power unit 59 by a slew type bearing 77 which pivots to allow the cutting apparatus 61 to swivel. The mast 75 is also attached to the power unit 59 by hydraulic cylinders 79 and 81 (two of each, only 1 shown) and control arms (not shown). The height of the rear of the cutting tool apparatus 61 is adjusted by adjusting the mast cylinders 79. Once the height of the rear of the cutting apparatus 61 is adjusted, the lower mast cylinders 79 are pressurized in a manner which continuously tries to retract the bottom of the mast 75 toward the power unit 59. This feature has the affect of transferring the weight of the power unit 59 to the cutting apparatus 61, and thereby continuously forces the front roller 62 into maintaining contact with the road surface.

The weight transfer process discussed above allows for the weight of the power unit 59 to be transferred to the cutter housing 5. As much weight as possible must be applied on the housing 5 in order to ensure that the cutting drum 3 will be driven and held against the road surface during the required cutting cycle by the hydraulic cylinder 43. Sufficient weight is required so that the cutting cycle can be completed without the tool housing lifting up vertically.

The combination of the pressurized cylinders 79, the slew bearing 77 and the front roller assembly 83 enables the cutting tool apparatus 61 to self align with the road surface. As the cutting apparatus 61 is pushed along the surface of the road, the front roller 62 follows the plane of the road.

Because of the amount of weight placed on the cutting apparatus 61 due to the cylinders 79, the slew bearing 77 and the front roller assembly 83, the front roller 62 will almost always maintain contact across its width with whatever road plane it encounters. Since the tool cutting apparatus 61 is able to pivot about the slew bearing 77, the front roller assembly 83 continuously and automatically forces the cutter housing 5 and cutting drum 3 to be parallel to the road surface. In addition, the tool mast 75 can pivot vertically about the cylinders 79 and 81 via a conventional device type connection (not shown) that exists between the cylinders 79, 81 and the mast 75. This allows the cutting apparatus to adjust vertically if the cutting drum 3 is forced to move up or down due to a dip or rise in the road surface.

It is desirable that the cutting drum 3 be parallel to the road surface so that as the piston 43*a* of hydraulic cylinder 43 extends, the cutting drum 3 will engage the road surface and extend into the surface evenly across the length of the cut. The above-described leveling feature is self adjusting so that the operation of the cutting machine can meet and maintain a maximum forward speed and a maximum production capability.

An additional feature of the front roller assembly 83 is that it can be reorientated and locked relative to the cutter housing 5 such that the front roller 62 continues to follow the plane of the road surface, but the front roller assembly 83 will force the orientation of the cutter housing 5 and cutter drum 3 in a manner which is not parallel with the underlying road surface. The manual adjustment of the front roller assembly 83 requires loosening the front roller attachment bolts 71, rotating the front roller assembly 83 as required, and retightening the bolts 71 to relock the front roller assembly 83 to the cutter housing 5. Threaded rods 85 are then adjusted within corresponding threaded receptacles 86 until they abut against stops 87 and 89 to further reinforce the locked position of the front roller assembly 83.

The ability to reposition the front roller assembly 83 is required in the event that the specification for the cut requires the depression be wider and deeper on one side than on an opposite side thereof. By orientating the cutting drum 3 in a non-parallel manner relative to the underlying road surface, the cutting drum 3 is effectively located closer to the surface at one end thereof as compared to the other end. As the cylinder piston 43*a* extends the cutting drum 3 to engage the road surface, the cutting drum 3 is actually extended deeper into the road surface on one side of the cut than on the opposite side of the cut.

To achieve higher production while cycling the cutter, as forward speed increases, cutting drum rpm must be maintained to provide a minimum number of revolutions per cut. For example, when rumble strips are cut at a forward rate of about 180 feet per minute, the drum is cycling at a frequency of about 3 times per second. During that second, the cutter is actually in contact with the road to make each cut for about 0.2 seconds. If the cutter rpm is held constant at about 600 rpm, the cutter would make about 2 revolution per cut, yielding a quality product. As the number of revolutions per cut decreases, the quality of the cut decreases.

However, on each cyclic contact with the road surface, the cutting drum rotational speed drops off about 50% during the cut, such that the cutting drum 3 rotation decreases from 600 rpm to as little as about 300 rpm, thereby turning only one revolution per cut. At the same forward rate of about 180 feet per minute, the cuts are marginal, and at faster forward speeds, they become unacceptable.

Testing was conducted at various speeds to determine whether increased kinetic energy imparted to the cutting drum reduced the percentage drop in cutting drum rotational speed as the cutting drum was placed under load. To impart this increase in kinetic energy to the cutting drum, no-load cutting drum rotational speed was increased while the mass of the cutting drum was maintained constant.

A cutting machine was started, the engine increased to full speed and the machine operated at a production rate of about 150 to about 200 ft/min., cutting drum rotational speed of about 600 rpm; a production rate of about 180 to about 190 ft/min., cutting drum rotational speed of about 720 rpm; a production rate of about 200 ft/min., cutting drum rotational speed of about 720 rpm; a production rate of about 300 ft/min., cutting head rotational speed of about 720 rpm; and a production rate of about 371 ft/min., drum head rotational speed of about 720 rpm. Drum head speed was measured under a no-load condition and compared to drum head speed under load. At a production rate of about 180 to about 190 ft/min., drum head speed dropped from a no-load speed of 610 rpm to a load speed of 384 rpm and from a no-load speed of 720 rpm to a load speed of 542 rpm, a decrease of about 37% and 25%, respectively. This reduction in rpm is due to the inertial contact with the road surface and is expected to occur independently of the production rate. However, the reduction in rpm affects the production rate, since in order to obtain a satisfactory cut by having the cutting head in contact with the surface of the road for a sufficient number of revolutions, the production rate must be decreased. The calculated decrease in rpm's and revolutions per cut of the cutting head resulting from contact with the road surface at various production rates and rotational speeds is provided in Table I.

TABLE 1

| PRODUCTION RATE (FT/MIN.) | ROTATIONAL SPEED (NO-LOAD) (RPM) | ROTATIONAL SPEED (LOAD) (RPM) | REVOLUTIONS PER CUT* | % REDUCTION |
|---|---|---|---|---|
| 180–190 | 610 | 384 | 1.3 | 37% |
| 180–190 | 720 | 542 | 1.8 | 25% |
| 200 | 720 | 542* | 1.6 | 25% |
| 300 | 720 | 542* | 1.1 | 25% |
| 371 | 720 | 542* | 0.9 | 25% |
| 150 | 600 | 378* | 1.4 | 37% |
| 200 | 600 | 378* | 1.1 | 37% |

*Calculated values

These test results confirmed that by increasing kinetic energy of the cutting drum, the amount of drum head rotational speed slow down can be reduced as the drum head contacts the road surface, thereby allowing for higher production rates. However, increasing the available kinetic energy through increased drum head rotational speed is limited by the ability to maintain the cutting teeth in the drum head as the rapidly rotating drum head contacts the road surface. Furthermore, increasing available kinetic energy by increasing drum head mass is limited by the physical constraints of the drum head size needed to produce road surface cuts to a given specification.

Unexpectedly, the novel attachment of the flywheel gearbox provides an instantaneous increase in torque, by increasing kinetic energy (measured using the mass of the drum head) as much a five times. For example, a drum head mass of 600 pounds would equate, during operation, to a kinetic mass of about 3,000 pounds, and is expected to allow the cutting drum to maintain drum rotational speed within about 15% of its non-peak torque loaded value. The further addition of the novel design for retaining the cutting teeth and increased length of the teeth allows the drum to spin at more than 700 rpm, permitting cutting operation exceeding 300 feet per minute, about 60–100% faster than current practice. The increased rotational speed of the cutting head and the increased production rate reduces the time that the cutting head in contact with the road, but increases the number of rotations of the head for the unit time so that an acceptable cut is made. The design of the present invention keeps the plurality of cutting teeth in the cutting head biased into contact with the road even as the rapidly rotating teeth contact the road surface. However, the design also permits the rapid removal or worn teeth with new teeth, minimizing down time.

An additional advantage of incorporating the flywheel gear box of the present invention is that hydraulic stability has improved by stabilizing hydraulic pressures, thereby reducing the vibration of the system. In prior art designs which did not incorporate the flywheel gearbox, hydraulic pressures typically and routinely fluctuated between 5000 psi (the maximum value) under load to about 1000 psi in a no-load condition. With the incorporation of the flywheel gearbox, the hydraulic pressure is maintained within a constant range of about 2000–2500 psi regardless of the load condition. The removal of the pressure fluctuations has reduced the incidences of failures attributed to fatigue to hydraulic components, such as hoses, pumps, motors and valves.

Figure 8:
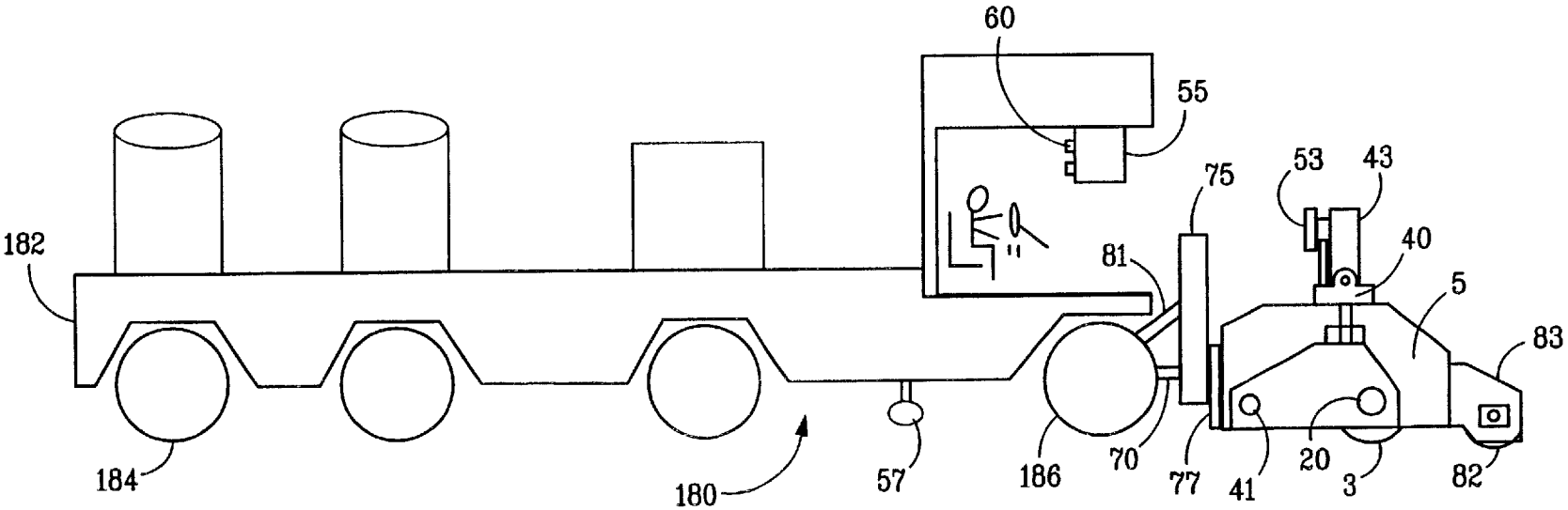
FIG. 8 is a side view of a flat bed truck utilized as a power unit.

As the power unit's length increases, for example, when a tractor trailer truck, such as flat bed truck 80, is utilized to carry all support materials, shown in FIG. 8, it becomes increasingly difficult for the operator to keep the cutting drum 3 properly aligned throughout a turn in the road surface. A radius often engineered into the turn compounds this problem. Traveling throughout the turn, there is a tendency for the rear end 182 of the power unit to track at an angle away from the road edge line (not shown), used as a reference position for the cutting drum. As the rear end 182 "skids" through the turn it causes the cutting drum to not track parallel to the edge line, which result in improper positioning of the cutting drum. To counteract this skidding, and hence, keep the cutting drum cutting parallel to the reference edge line, in a different embodiment, the rear wheels 184 of the power unit are, using conventional means, able to be turned independent of the front wheels 186, thereby avoiding the skid. This turning may be operator controlled, or it may be performed automatically, through the use of, for example, photoelectric sensors inputting signals to an electronic controller.

681 In operation, the operator first orientates the power unit 59 and cutting apparatus 61 over the area to be cut. The cutting drum 3 is suspended and held by the tool cylinder 43 at a hover point above the road surface. Then, the cutting drum 3 is generally orientated parallel to the road surface by adjusting the front roller assembly 83. However, as mentioned above, the front roller assembly 83 can be adjusted such that the cutting drum 3 is not parallel to the underlying surface in the event that a specification or road condition requires a cut which is inconsistent across its length. The operator then engages the drive mechanism of the power unit 59 and moves the cutting apparatus 61 forward. As the power unit 59 advances, the encoder 57 instructs the computer controller 55 to begin executing its programmed instructions and provides a signal to the controller 55 which is indicative of the distance traveled along the road surface. The computer controller 55, based on the signal from the encoder 57, sends signals to the servo valve 53 which controls the movement of the piston 43*a* of tool cylinder 43, such that the cutting drum 3 is vertically moved into and out of contact with the road surface in a precise manner as it moves across the road surface. The movement of the piston 43*a* is set at a rate which is proportional to the forward speed of the power unit. In other words, the encoder continually supplies the computer with a signal indicative of detected forward movement of the power unit 59 and the computer controller 55 adjusts the piston 43*a* in relation to the forward movement such that the specified depression cut size is obtained. The increased kinetic energy produced by the flywheel 162 as needed limits cutting drum slow down as it encounters peak torque values produced by initial contact of the cutting drum 3 with the road surface.

The operator steers the power unit 59 to maintain the alignment of the cuts and monitors the computer to ensure that the program cycles are being completed. The operator further controls the operation by adjusting the maximum forward speed and production rate of the cutting machine 1 according to such things as road surface density or hardness. For example, if the road surface is easier to cut because it is soft, the operator will advance the power unit 59 forward at a faster rate in order to increase production. Moreover, due to the self-aligning features of the tool housing 5, the housing 5 will continuously self-adjust itself both horizontally and vertically to the road surface which allows the operator to proceed without stopping to make adjustments to the housing orientation. The resulting pattern left by the cutting apparatus 61 is a series of rumble strip depressions which are typically spaced about twelve inches on center. The actual spacing and number of depressions, however, for a given project may vary and are dictated by the specifications for the project.

While a single embodiment of the invention has been described, it will be understood that it is capable of still further modifications, and this application is intended to cover any variations, uses, or adaptations of the invention, following in general the principles of the invention and including such departures from the present disclosure as to come with the knowledge of customary practice in the art to which the invention pertains, and as may be applied to the essential features herein before set forth and falling within the scope of the invention or the limits of the appended claims.

What is claimed is:

1. A cutting machine for cutting depressions in a road surface, comprising:

a rotatable cutting drum;

a plurality of cutting teeth, said teeth removably retained to said cutting drum to effectively cut the road surface;

a drive system for rotating said cutting drum, wherein said drive system further includes a gear box comprising a flywheel on an input side of said gearbox, the flywheel being configured to retain inertial kinetic energy as the cutting drum is brought into and out of contact with the road surface;

engaging means for moving said cutting drum out of and into contact with the road surface; and means for moving said cutting drum along the road surface;

wherein a rate of travel of said moving means corresponds to a minimum rotational speed of said cutting drum.

2. The cutting machine of claim 1, wherein each of said plurality of cutting teeth includes a means for anchoring a tooth shank to a tooth holder, the tooth holder permanently affixed to the cutting drum.

3. The cutting machine of claim 1, wherein the moving means is a power unit.

4. The cutting machine of claim 1, wherein the means for moving the cutting drum along the road surface includes a means to prevent rear end skid.

5. The cutting machine of claim 4, wherein the means to prevent rear end skid comprises a rear set independently steerable wheels.

6. A cutting machine for cutting depressions in a road surface, comprising:

a rotatable cutting drum;

a plurality of cutting teeth for effectively cutting the road surface, said teeth removably retained to a tooth holder by a retaining member anchoring a tooth shank within said tooth holder, said tooth holder permanently affixed to the cutting drum so that a cutting surface of each of said cutting teeth projects radially from the cutting drum;

a drive system for rotating the cutting drum, wherein the drive system includes a gear box comprising a flywheel on an input side of said gearbox, the flywheel being configured to retain inertial kinetic energy as the cutting drum is brought into and out of contact with the road surface;

engaging means for moving the cutting drum out of and into contact with the road surface;

means for moving the cutting drum along the road surface;

means for continually detecting the distance that the cutting drum is moved by the moving means and for generating a signal indicative of the distance moved;

electronic control means, responsive to the signal, for electronically controlling the engaging means so that the cutting drum moves out of and into contact with the road surface in accordance with the distance that the cutting drum moves along the road surface and in accordance with a specified dimensional profile of the depressions which are stored in a memory of the electronic control means, thereby cutting the depressions;

means for continuously aligning said cutting drum with a slope of the road surface; and a housing in which the cutting drum is mounted, and means for adjustably mounting the front roller assembly on said housing;

wherein the front roller assembly includes a roller rotatably mounted in a frame, the frame having adjusting slots therein and being connected to the housing via bolts which pass through the slots and into corresponding openings in the housing;

wherein the housing includes first and second adjustable screws attached thereto, the frame further includes first and second stop members mounted thereon, and the first and second screws are each adjustable to contact a corresponding one of the stop members to lock the frame in place relative to the housing; and wherein a rate of travel of said moving means corresponds to a minimum rotational speed of said cutting drum.

7. The cutting machine of claim 6, wherein the means for moving the cutting drum along the road surface includes a means to prevent rear end skid.

8. The cutting machine of claim 6, wherein said means for continuously aligning includes a slew type bearing which is connected to the cutting drum and the means for moving.

9. A cutting machine for cutting depressions in a road surface, comprising:

a rotatable cutting drum;

a plurality of cutting teeth for effectively cutting the road surface, said teeth removably retained to a tooth holder by a retaining member anchoring a tooth shank within said tooth holder, said tooth holder permanently affixed to the cutting drum;

a drive system for rotating the cutting drum, wherein the drive system includes a gear box comprising a flywheel on an input side of said gearbox, the flywheel being configured to retain inertial kinetic energy as the cutting drum is brought into and out of contact with the road surface;

engaging means for moving the cutting drum out of and into contact with the road surface;

means for moving the cutting drum along the road surface;

means for continuously detecting a distance that the cutting drum is moved by the moving means and for generating a signal indicative of the distance moved; and electronic control means, responsive to the signal, for electronically controlling the engaging means so that the cutting drum moves out of and into contact with the road surface in accordance with the distance that the cutting drum moves along the road surface and in accordance with a specified dimensional profile of the depressions which are stored in the electronic control means, thereby cutting the depressions;

wherein the rotatable cutting drum is mounted within a housing having four walls and the engaging means includes a first hydraulic cylinder mounted on the housing and connected to the cutting drum such that as the hydraulic cylinder moves a stroke distance under control of the electronic control means, said cutting drum moves relative to said housing out of and into contact with the road surface; and wherein a rate of travel of said moving means corresponds to a minimum rotational speed of said cutting drum.

10. The cutting machine of claim 9, wherein the means for moving the cutting drum along said road surface includes a means to prevent rear end skid.

11. The cutting machine of claim 10 wherein the means for moving the cutting drum along the road surface is a tractor trailer truck and the means to prevent rear end skids are independently steerable rear wheels on a trailer portion of the truck.

12. The cutting machine of claim 10, wherein the moving means is a power unit, the detecting means is an encoder and the electronic control means is a computer.

13. The cutting machine of claim 10, further comprising pivoting means for allowing the cutting drum to pivot relative to the housing, the pivoting means including a shaft rotatably mounted in the housing and connected to the cutting drum.

14. The cutting machine of claim 10, wherein the power unit includes a mast which is connected to the housing, and a second hydraulic cylinder which is connected to the mast and which is pressurized to apply a force to the mast which transfers a weight of the power unit to the housing in opposition to the upward movement of the housing away from the road surface.

15. The cutting machine of claim 10, further comprising means for warning that the cutting drum has not moved as directed by the electronic control means, the warning means including a sensor which detects a stroke movement of the first hydraulic cylinder and provides a signal indicative of the stroke movement to the electronic control means.

16. A method for cutting depressions in a road surface including:

moving a cutting drum along the road surface, the cutting drum comprising a plurality of cutting teeth, said teeth removably retained to said cutting drum to effectively cut the road surface and including a means for anchoring a tooth shank to a tooth holder, the tooth holder permanently affixed to said cutting drum;

rotating the cutting drum by a gear box, wherein power for rotating the cutting drum is provided by a flywheel and a hydraulic motor positioned on an input side of said gearbox, the flywheel being configured to retain inertial kinetic energy as the cutting drum is brought into and out of contact with the road surface;

controlling movement of the cutting drum into and out of engagement with the road surface such that a rate of travel of said moving means corresponds to a minimum rotational speed of said cutting drum; and mounting the cutting drum within a housing having four walls such that when the cutting drum is moved into and out of engagement with the road surface, said cutting drum moves relative to said housing.

17. A method for cutting depressions in a road surface including:

moving a cutting drum horizontally relative to the road surface, the cutting drum comprising a plurality of cutting teeth, said teeth removably retained to the cutting drum to effectively cut the road surface upon engagement, the teeth including a means for anchoring a tooth shank to a tooth holder, the tooth holder permanently affixed to said cutting drum;

rotating the cutting drum by a gear box wherein power for rotating the cutting drum is provided by a flywheel and a hydraulic motor positioned on an input side of said gearbox, the flywheel being configured to retain inertial kinetic energy as the cutting drum is brought into and out of contact with the road surface;

continuously detecting a distance the cutting drum moves horizontally along the road surface and supplying electronic impulses representative of the distance moved by the cutting drum to an electronic control means;

electronically controlling movement of the cutting drum in a direction substantially perpendicular to the horizontal movement of the drum, into and out of engagement with the road surface using the electronic control means, the substantially perpendicular movement into and out of engagement being based upon the detected distance moved horizontally by the drum along the road surface, the perpendicular movement causing the rotating drum to cut depressions in the road surface, a dimensional profile of the depressions stored within the electronic control means, such that the depressions are cut to provide the dimensional profile irrespective of variations in a speed of horizontal movement of said cutting drum relative to the road surface, such that the speed of horizontal movement of said cutting drum corresponds to a minimum rotational speed of said cutting drum; and mounting the cutting drum within a housing having four walls such that when the cutting drum is moved substantially perpendicular into and out of engagement with the road surface, the cutting drum moves relative to the housing.

18. The method for cutting depressions of claim 17, further comprising the additional step of automatically aligning the cutting drum to be substantially parallel with the road surface as the cutting drum moves horizontally relative to the road surface.

19. The method for cutting depressions of claim 17, further comprising the additional step of adjusting the cutting drum so that it is not parallel with the road surface as the cutting drum moves horizontally relative to the road surface in order to cut depressions into the roadway of varying depth along a length of the depressions, the depression length being substantially perpendicular to the horizontal movement of the cutting drum.

20. The method for cutting depressions of claim 17 wherein moving the cutting drum is accomplished by a tractor trailer truck.

21. The method for cutting depressions of claim 20, further comprising a step of preventing rear end skid.

22. The method for cutting depressions of claim 21 wherein the step of preventing rear end skid includes providing independently steerable rear wheels on the trailer portion of the truck.

* * * * *